US008777199B2

(12) United States Patent
Webb

(10) Patent No.: US 8,777,199 B2
(45) Date of Patent: Jul. 15, 2014

(54) HYDRAULIC CLAMPING DEVICE

(75) Inventor: Jonathan Garrick Webb, Kristiansand S (NO)

(73) Assignee: National Oilwell Varco Norway AS, Kristiansand S (NO)

( * ) Notice: Subject to any disclaimer, the term of this patent is extended or adjusted under 35 U.S.C. 154(b) by 665 days.

(21) Appl. No.: 12/999,546

(22) PCT Filed: Jun. 15, 2009

(86) PCT No.: PCT/NO2009/000221
§ 371 (c)(1), (2), (4) Date: Mar. 14, 2011

(87) PCT Pub. No.: WO2009/154469
PCT Pub. Date: Dec. 23, 2009

(65) Prior Publication Data
US 2012/0104674 A1 May 3, 2012

(30) Foreign Application Priority Data
Jun. 18, 2008 (NO) ..... 20082732

(51) Int. Cl.
*B23Q 3/08* (2006.01)

(52) U.S. Cl.
USPC ..... 269/25

(58) Field of Classification Search
USPC ..... 269/26, 27, 32, 35, 156, 25, 105, 272
See application file for complete search history.

(56) References Cited

U.S. PATENT DOCUMENTS

| | | | | |
|---|---|---|---|---|
| 1,642,508 | A * | 9/1927 | Robinson | 269/26 |
| 2,428,185 | A * | 9/1947 | Wallace | 269/30 |
| 3,131,586 | A | 5/1964 | Wilson | |
| 4,739,681 | A * | 4/1988 | Pietras | 81/57.16 |

OTHER PUBLICATIONS

PCT International Search Report (PCT/NO2009/000221) issued Sep. 17, 2009, Nordic Patent Institute (ISA/NO), Bjorn Inge Kalland (Authorized Officer) (2 pages).
PCT Written Opinion of the International Searching Authority (PCT/NO2009/000221) issued Sep. 17, 2009, Nordic Patent Institute (ISA/NO), Bjorn Inge Kalland (Authorized Officer) (4 pages).
PCT Written Opinion of the International Searching Authority (PCT/NO2009/000221) issued Mar. 5, 2010, Nordic Patent Institute (IPEA), Bjorn Inge Kalland (Authorized Officer) (4 pages).

* cited by examiner

*Primary Examiner* — Joseph J Hail
*Assistant Examiner* — Jamal Daniel
(74) *Attorney, Agent, or Firm* — Conley Rose, P.C.

(57) ABSTRACT

A hydraulic clamping device comprises clamping piece supported in a structure. In addition, the clamping device comprises a hydraulic cylinder having a longitudinal axis and including a cylinder housing fixedly connected to the structure. Further, the clamping device comprises an intermediate piece axially disposed between the piston and the clamping piece. The hydraulic cylinder is adapted to exert a force along the longitudinal axis against the clamping piece.

8 Claims, 4 Drawing Sheets

II-II

Ia–Ia

Ib–Ib

HYDRAULIC CLAMPING DEVICE

CROSS REFERENCE TO RELATED APPLICATION

This application is a National Phase entry of PCT Application No. PCT/NO2009/000221, filed Jun. 15, 2009 which claims priority to Norwegian Application No. 20082732, filed Jun. 18, 2008, each of which is hereby incorporated herein by reference in its entirety.

STATEMENT REGARDING FEDERALLY SPONSORED RESEARCH OR DEVELOPMENT

Not applicable.

BACKGROUND

1. Field of the Invention

The invention relates to a hydraulic clamping device. More particularly, the invention relates to a hydraulic clamping device, wherein a clamping piece is supported in a structure, and wherein a cylinder housing of a hydraulic cylinder is fixedly connected to the structure, the hydraulic cylinder being arranged to exert, along a longitudinal axis thereof, a force against the clamping piece.

2. Background of the Technology

To be able to isolate a hydraulic cylinder from the forces acting perpendicularly to the piston in the cylinder, and in the displacement direction, it is common to connect the cylinder housing to a structure by means of a pivotal mounting. Preferably, mountings of this sort should be pivotal about at least two axes, therefore being relatively space-demanding.

Oftentimes known cylinder mountings require the cylinder to be at least partly incorporated into the structure, which may limit the possible cylinder diameters, thereby requiring use of a pressure booster to obtain sufficient force. Incorporated cylinders may also complicate the conveyance of pipes onwards to the cylinder.

A link-supported cylinder requires pressurised fluid to be supplied via a flexible connection, for example a hose, or via a pivotal coupling. Hoses and pivotal couplings constitute components prone to leaks.

The object of the invention is to remedy or reduce at least one of the disadvantages of the prior art.

The object is achieved in accordance with the invention and the features disclosed in the following description and in the subsequent claims.

SUMMARY OF THE PREFERRED EMBODIMENTS

A hydraulic clamping device is provided, wherein a clamping piece is supported in a structure, and wherein a cylinder housing of a hydraulic cylinder is fixedly connected to the structure, the hydraulic cylinder being arranged to exert, along a longitudinal axis thereof, a force against the clamping piece. The hydraulic clamping device is characterized in that a piston in the hydraulic cylinder is isolated from the clamping piece with respect to forces acting perpendicularly relative to the longitudinal axis.

Forces acting on the clamping piece in other directions than the longitudinal direction of the cylinder are thereby transmitted only to a limited extent to the piston in the cylinder. Thus it is avoided that the cylinder's piston rod must be able to withstand a bending moment, which considerably simplifies the cylinder structure.

The support in the structure for the clamping piece may, for example, be comprised of a guide or a pivot-bearing.

The guide or the pivot-bearing is arranged so as to be able to withstand the forces acting on the clamping piece in other directions than the axial direction of the cylinder. The guide may be comprised of several cooperating guide surfaces allowing for displacement of the clamping piece in one direction. A pivot-bearing may, for example, comprise a shaft with an associated bearing.

The hydraulic cylinder may be connected to the clamping piece by means of an intermediate piece, wherein the intermediate piece may be provided with a pivot-bearing in at least one of its end portions. The pivot-bearing may comprise a spherical portion.

The intermediate piece may be arranged so as to be able to only transmit forces between the piston and the clamping piece in a first direction, whereas a strut may be arranged so as to be able to transmit forces between the piston and the clamping piece in an opposite direction. In an alternative embodiment, the clamping piece may be biased in the direction toward the cylinder, for example by means of a spring.

The coupling between the piston and the intermediate piece, as well as between the clamping piece and the intermediate piece, may thus be comprised of uncomplicated structures, insofar as the force transmitted via the intermediate piece only constitutes a compressive force.

For example, the strut may be comprised of a bolt extending through the clamping piece and the intermediate piece and into the piston. Thereby, the strut entrains the clamping piece when the piston is displaced in its negative direction. Advantageously, the strut has a radial clearance in the clamping piece and the intermediate piece, whereby a certain radial displacement of the clamping piece and the intermediate piece may take place without exposing the strut to bending forces.

Several clamping pieces, which are connected to their respective hydraulic cylinders, may be cooperating. This is advantageous when, for example, pipes are to be gripped, and where the pipe diameters may vary from time to time.

Guides cooperating with the clamping piece may be fixedly connected to the structure. Thereby, a stable and relatively compact design is obtained.

Generally, the displacement direction of the clamping piece may coincide with the displacement direction of the piston. By having a substantially equal displacement direction, transmission links may be avoided, for example. Advantageously, the cylinder acts directly onto the clamping piece via the intermediate piece.

The cylinder housing may be located outside the structure and may, for example, be flanged onto the structure. Thus, the structure does not restrict the cylinder diameter possible, nor does it obstruct the conveyance of pipe connections onwards to the cylinder.

A hydraulic clamping device in accordance with embodiments described herein is particularly suitable for use in a power tong for gripping around a pipe. The cylinder diameter may be selected based on the required gripping force and fluid pressure available, simultaneously allowing for a compact and robust design.

BRIEF DESCRIPTION OF THE DRAWINGS

In the following, an example of a preferred embodiment is described and depicted in the accompanying drawings, where.

DETAILED DESCRIPTION OF THE PREFERRED EMBODIMENTS

Figure 1:
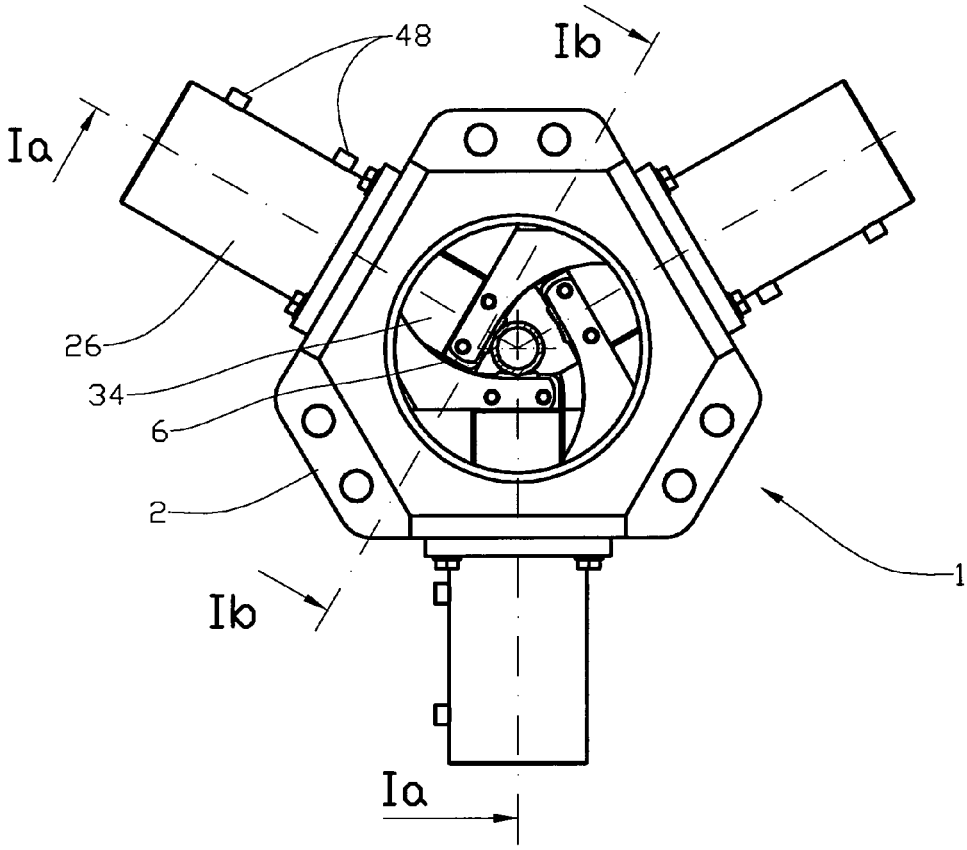
FIG. 1 shows a plan view of an embodiment of a hydraulic gripping device in accordance with the principles described herein.
Figure 2:
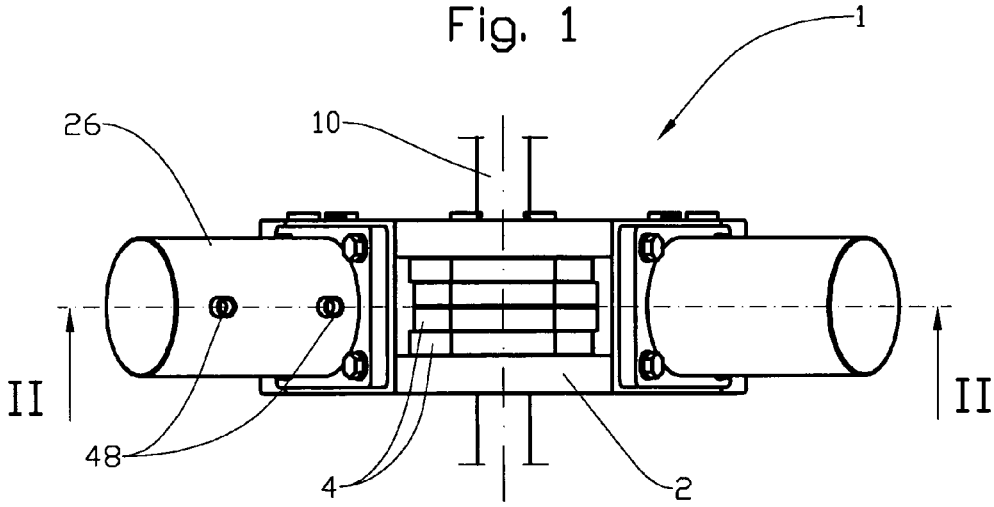
FIG. 2 shows a side view of the gripping device of FIG. 1.

In the drawings, reference numeral 1 denotes an embodiment of a hydraulic clamping device in the form of a power tong comprising a structure 2, wherein the structure 2 is provided with guides 4.

A clamping piece 6 cooperates in a displaceable manner with the guides 4. The clamping piece 6 is formed with a jaw 8 facing a pipe 10 to be gripped.

Figure 6:
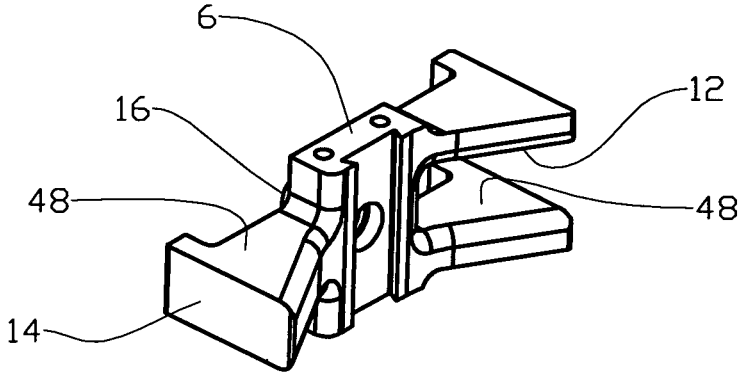
FIG. 6 is a perspective view of a clamping piece.

The clamping piece 6 is formed so as to be able to cooperate with adjacent clamping pieces 6, insofar as one side of the clamping piece 6 is given a fork-shape having an intermediate recess 12, see FIG. 6, and the opposite side thereof is formed with an arm portion 14. During mutual displacement of the clamping pieces 6, the recess 12 forms an opening for the arm portion 14 of the adjacent clamping piece 6.

Figure 3:
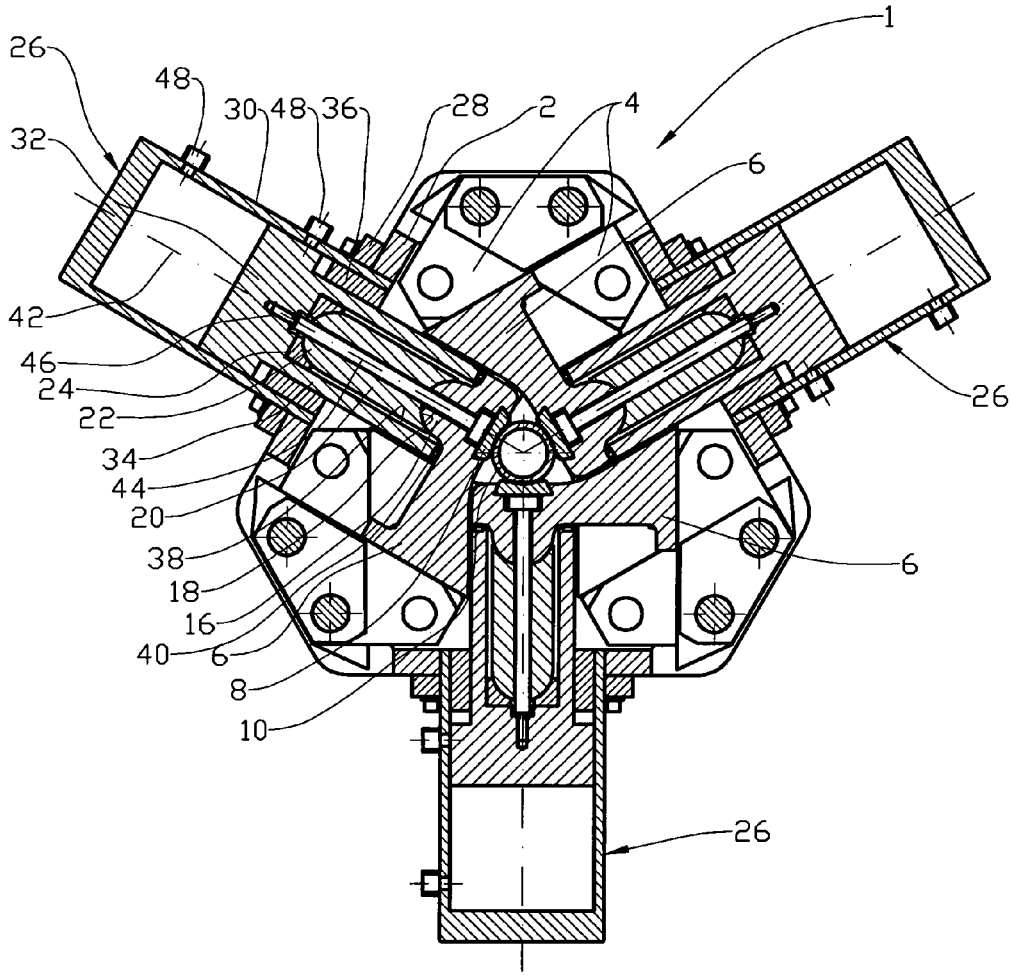
FIG. 3 shows an enlarged cross-sectional view of the hydraulic gripping device of FIG. 1 taken along section II-II shown in FIG. 2.
Figure 4:
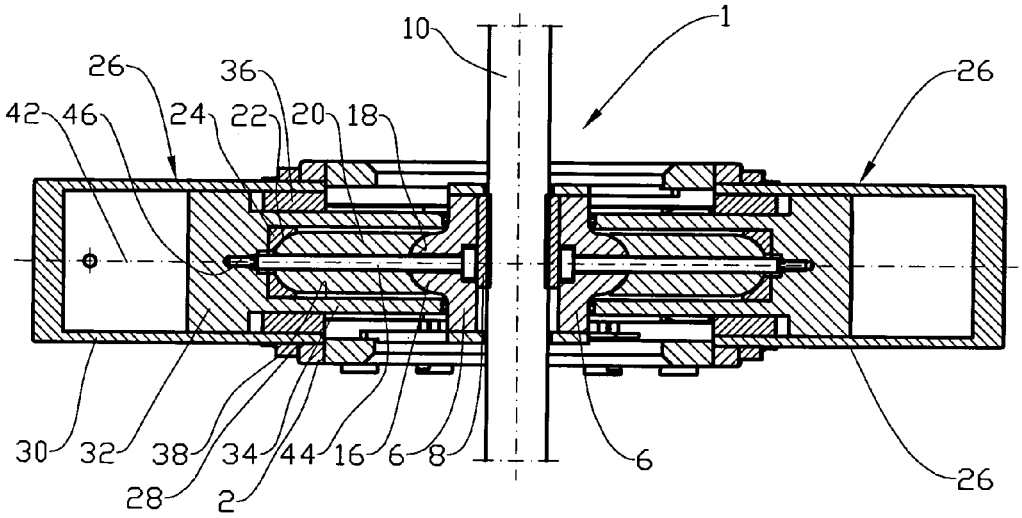
FIG. 4 shows an enlarged cross-sectional view of the hydraulic gripping device of FIG. 1 taken along section Ia-Ia shown in FIG. 1.
Figure 5:
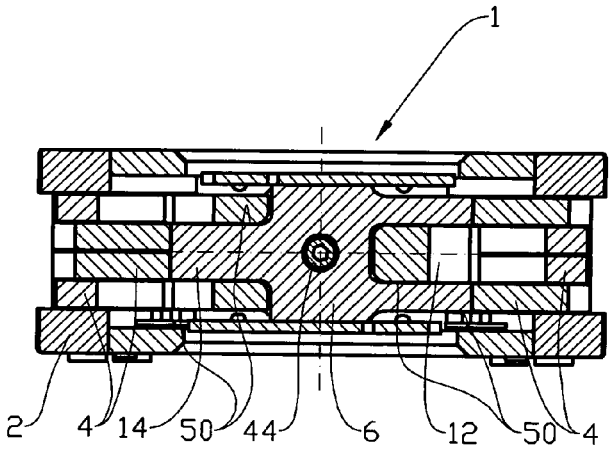
FIG. 5 shows an enlarged cross-sectional view of the hydraulic gripping device of FIG. 1 taken along section Ib-Ib shown in FIG. 1.

Opposite the jaw 8, the clamping piece 6 is formed with an outwardly extending, spherical bulb 16 fitting in a complementary manner within a spherical recess 18 in an intermediate piece 20, see FIGS. 3 and 4. In the opposite end thereof, the intermediate piece 20 is formed with a spherical end portion 22 fitting within a spherical bearing 24.

A hydraulic cylinder 26 is fixedly connected to the structure 2 by means of a flange connection 28. A piston 32 with a piston rod 34 extends within the cylinder housing 30 of the hydraulic cylinder 26. The piston rod 34 extends in a displaceable manner through an end wall 36. Seals in the cylinder are not shown.

The bulb 16, the intermediate piece 20 and the bearing 24 are located in a central bore 38 in the piston rod 34 and are sealed from the surroundings by means of a gasket 40 located between the piston rod 34 and the clamping piece 6. The bearing 24 abuts the bottom of the bore 38.

A longitudinal axis 42 of the hydraulic cylinder 26 generally coincides with the displacement direction of the clamping piece 6.

A strut 44 in the form of a bolt extends through the clamping piece 6, the intermediate piece 20, the bearing 24 and into a threaded bore 46 in the piston 32. The strut 44 is arranged so as to be able to entrain the clamping piece 6 when the piston 32 is displaced in its negative direction. The strut 44 is formed with some radial clearance relative to the clamping piece 6 and the intermediate piece 20.

Pressurised fluid is supplied, in a manner known in the art, to ports 48 in the hydraulic cylinder 26.

In this embodiment, the clamping device 1 comprises three clamping pieces 6 with associated cylinders 26, each of which is formed as described above.

When the pipe 10 is to be gripped, the pistons 32 are displaced in their positive direction and thus displace the jaws 8, by means of respective bearings 24, intermediate pieces 20 and clamping pieces 6, until engagement with the pipe 10.

The clamping force from the jaws 8 is transmitted to the respective piston 32, whereas forces in the tangential direction of the pipe 10 are carried by the guides 4 via the clamping piece 6, and forces in the axial direction of the pipe 10 are carried by supports 50 disposed mutually between the clamping pieces 6, and between the clamping pieces 6 and the structure 2.

The invention claimed is:

1. A hydraulic clamping device, comprising:

a clamping piece supported in a structure;

a hydraulic cylinder having a longitudinal axis and including a cylinder housing fixedly connected to the structure and a piston moveably disposed in the cylinder housing;

an intermediate piece axially disposed between the piston and the clamping piece; and a bearing axially disposed between the piston and the intermediate piece;

wherein the hydraulic cylinder is configured to exert a force along the longitudinal axis against the clamping piece;

wherein the clamping piece is coupled to the intermediate piece through a first pair of mating spherical surfaces in sliding engagement, wherein a first surface of the first pair of mating spherical surfaces is disposed on the clamping device and a second surface of the first pair of mating spherical surfaces is disposed on the intermediate piece;

wherein the intermediate piece is coupled to the bearing through a second pair of mating spherical surfaces in sliding engagement, wherein a first surface of the second pair of mating spherical surfaces is disposed on the intermediate piece and a second surface of the second pair of mating spherical surfaces is disposed on the bearing.

2. The hydraulic clamping device of claim 1, wherein a support in the structure for the clamping piece comprises a guide.

3. The hydraulic clamping device of claim 1, wherein a support in the structure for the clamping piece comprises a pivot-bearing.

4. The hydraulic clamping device of claim 1, further comprising a strut extending axially through the intermediate piece and having a first end and a second end opposite the first end, wherein the first end is directly connected to the piston and the second end is directly connected to the clamping piece.

5. The hydraulic clamping device of claim 1, further comprising a plurality of guides that cooperate with the clamping piece and are fixedly connected to the structure.

6. The hydraulic clamping device of claim 1, wherein a displacement direction of the clamping piece substantially coincides with a displacement direction of the piston.

7. The hydraulic clamping device of claim 1, wherein the cylinder housing is positioned outside the structure.

8. The hydraulic clamping device of claim 1, wherein the first surface of the first pair of mating spherical surfaces comprises a convex spherical surface;

wherein the second surface of the first pair of mating spherical surfaces comprises a concave spherical surface;

wherein the first surface of the second pair of mating spherical surfaces comprises a convex spherical surface; and wherein the second surface of the second pair of mating spherical surfaces comprises a concave spherical surface.

* * * * *